US008485756B2

(12) United States Patent
Hall et al.

(10) Patent No.: US 8,485,756 B2
(45) Date of Patent: Jul. 16, 2013

(54) HEATED LIQUID NOZZLES INCORPORATED INTO A MOLDBOARD

(76) Inventors: David R. Hall, Provo, UT (US); David Wahlquist, Spanish Fork, UT (US)

( * ) Notice: Subject to any disclaimer, the term of this patent is extended or adjusted under 35 U.S.C. 154(b) by 0 days.

(21) Appl. No.: 12/978,208

(22) Filed: Dec. 23, 2010

(65) Prior Publication Data

US 2011/0091276 A1 Apr. 21, 2011

Related U.S. Application Data

(63) Continuation-in-part of application No. 12/888,876, filed on Sep. 23, 2010, now Pat. No. 7,976,238, which is a continuation-in-part of application No. 12/145,409, filed on Jun. 24, 2008, now Pat. No. 7,854,566, which is a continuation-in-part of application No. 11/566,151, filed on Dec. 1, 2006, now Pat. No. 7,458,645, and a continuation-in-part of application No. 11/668,390, filed on Jan. 29, 2007, now Pat. No. 7,507,053, and a continuation-in-part of application No. 11/644,466, filed on Dec. 21, 2006, now Pat. No. 7,596,975.

(51) Int. Cl.
*E01C 7/06* (2006.01)
*E01C 23/12* (2006.01)

(52) U.S. Cl.
USPC ..... 404/94; 404/77; 404/95; 239/1; 239/104; 299/39.4

(58) Field of Classification Search
USPC ..... 404/17, 71, 75, 77, 79, 89–92, 94, 404/111; 239/1, 104; 299/39.4
See application file for complete search history.

(56) References Cited

U.S. PATENT DOCUMENTS

| | | | |
|---|---|---|---|
| 1,898,158 | A | 2/1933 | Winkle |
| 2,039,078 | A | 4/1936 | Hertwig |
| 1,887,341 | A | 11/1936 | Venable |
| 2,098,895 | A | 11/1937 | Velten |
| 2,124,438 | A | 7/1938 | Struk |
| 2,633,782 | A | 4/1953 | Clement |
| 2,893,299 | A | 7/1959 | Moir |
| 2,908,206 | A | 10/1959 | Melanson |
| 2,938,438 | A | 5/1960 | Hamilton |
| 3,075,436 | A | 1/1963 | McRae |
| 3,254,392 | A | 6/1966 | Novkov |
| 3,361,042 | A | 1/1968 | Cutler |
| 3,732,023 | A | 5/1973 | Rank |
| 3,746,396 | A | 7/1973 | Radd |
| 3,817,644 | A | 6/1974 | Matson |
| 3,830,321 | A | 8/1974 | McKenry |
| 3,946,506 | A | 3/1976 | Snow, Jr. et al. |
| 3,970,404 | A | 7/1976 | Benedetti |
| 3,989,401 | A | 11/1976 | Moench |
| 4,018,540 | A | 4/1977 | Jackson |
| 4,098,362 | A | 7/1978 | Bonnice |
| 4,104,736 | A | 8/1978 | Mendenhall |
| 4,109,737 | A | 8/1978 | Bovenkerk |

(Continued)

*Primary Examiner* — Raymond W Addie
(74) *Attorney, Agent, or Firm* — Philip W. Townsend, III

(57) ABSTRACT

A motorized vehicle comprises a vehicle frame with a forward and rearward end. A rotary degradation drum is connected to an underside of the frame. A moldboard is disposed rearward to the rotary degradation drum and forms part of a milling chamber. The moldboard comprises an end disposed opposite the underside. A plurality of nozzles are disposed proximate the end of the moldboard and are configured to direct a fluid into the milling chamber. A heating mechanism is configured to heat the fluid.

19 Claims, 10 Drawing Sheets

U.S. PATENT DOCUMENTS 4,124,325 A 11/1978 Cutler
4,127,351 A 11/1978 Vural
4,139,318 A 2/1979 Jakob
4,156,329 A 5/1979 Daniels
4,172,616 A 10/1979 Delli-Gatti, Jr.
4,172,679 A 10/1979 Wirtgen
4,175,886 A 11/1979 Moench
4,195,946 A 4/1980 Swisher
4,199,035 A 4/1980 Thompson
4,201,421 A 5/1980 Den Besten
4,215,949 A 8/1980 Gabriel
4,261,669 A 4/1981 Edo
4,268,089 A 5/1981 Spence
4,313,690 A 2/1982 Hojbjerg
4,325,580 A 4/1982 Swisher, Jr. et al.
4,335,975 A 6/1982 Schoelkopf
4,347,016 A 8/1982 Sindelar et al.
4,407,605 A 10/1983 Wirtgen
4,439,250 A 3/1984 Acharya
4,473,320 A 9/1984 Register
4,484,783 A 11/1984 Emmerich
4,534,674 A 8/1985 Cutler
4,592,507 A * 6/1986 Benedict ..... 239/172
4,594,022 A 6/1986 Jeppson
4,668,017 A 5/1987 Petersen
4,676,689 A 6/1987 Yant
4,684,176 A 8/1987 Den Besten
4,692,350 A * 9/1987 Clarke et al. ..... 427/138
4,725,098 A 2/1988 Beach
4,728,153 A 3/1988 Ojanen
4,776,862 A 10/1988 Wiand
4,784,518 A 11/1988 Cutler
4,793,730 A 12/1988 Butch
4,812,076 A * 3/1989 Yant ..... 404/108
4,827,559 A 5/1989 Norland
4,836,614 A 6/1989 Ojanen
4,850,649 A 7/1989 Beach
4,880,154 A 11/1989 Tank
4,921,310 A 5/1990 Hedlund
4,932,723 A 6/1990 Mills
4,940,288 A 7/1990 Stiffler
4,944,559 A 7/1990 Sionnet et al.
4,951,762 A 8/1990 Lundell
4,968,101 A 11/1990 Bossow
5,007,685 A 4/1991 Beach
5,026,205 A 6/1991 Gorski
5,074,063 A 12/1991 Vannette
5,078,540 A 1/1992 Jakob
5,112,165 A 5/1992 Hedlund
5,131,788 A 7/1992 Hulicsko
5,141,289 A 8/1992 Stiffler
5,186,892 A 2/1993 Pope
5,219,380 A 6/1993 Young
5,251,964 A 10/1993 Ojanen
5,303,984 A 4/1994 Ojanen
5,366,320 A 11/1994 Hanlon
5,382,084 A 1/1995 Diver
5,392,540 A 2/1995 Cooper
5,415,462 A 5/1995 Massa
RE35,088 E 11/1995 Gilbert
5,490,339 A 2/1996 Accettola
5,503,463 A 4/1996 Ojanen
5,505,598 A 4/1996 Murray
5,556,225 A 9/1996 Marino
5,720,528 A 2/1998 Ritchey
5,725,283 A 3/1998 O'Neill
5,730,502 A 3/1998 Montgomery
5,738,698 A 4/1998 Kapoor
5,765,926 A 6/1998 Knapp
5,791,814 A 8/1998 Wiley
5,794,854 A 8/1998 Yie
5,823,632 A 10/1998 Burkett
5,837,071 A 11/1998 Andersson
5,884,979 A 3/1999 Latham
5,934,542 A 8/1999 Nakamura
5,935,718 A 8/1999 Demo
5,944,129 A 8/1999 Jensen
5,947,636 A 9/1999 Mara
5,947,638 A 9/1999 Heims
5,951,561 A 9/1999 Pepper
6,051,079 A 4/2000 Andersson
6,065,552 A 5/2000 Scott
6,113,195 A 9/2000 Mercier
6,122,601 A 9/2000 Swanson
6,158,920 A 12/2000 Malot
6,193,770 B1 2/2001 Sung
6,196,636 B1 3/2001 Mills
6,199,956 B1 3/2001 Kammerer
6,287,048 B1 9/2001 Hollon
6,341,823 B1 1/2002 Sollami
6,357,832 B1 3/2002 Sollami
6,371,689 B1 4/2002 Wiley
6,457,267 B1 10/2002 Porter
6,478,383 B1 11/2002 Ojanen
6,481,803 B2 11/2002 Ritchey
6,508,516 B1 1/2003 Kammerer
6,543,963 B2 4/2003 Bruso
6,551,018 B2 4/2003 Baker
6,565,281 B2 * 5/2003 Bruns et al. ..... 404/90
6,577,141 B2 6/2003 Gandrud
6,623,207 B2 9/2003 Grubba
6,644,755 B1 11/2003 Kammerer
6,692,083 B2 2/2004 Latham
6,702,393 B2 3/2004 Mercier
6,733,086 B1 5/2004 McSharry
6,769,836 B2 8/2004 Lloyd
6,779,948 B2 8/2004 Bruso
6,786,557 B2 9/2004 Montgomery, Jr.
6,799,922 B2 10/2004 Smith
6,824,225 B2 11/2004 Stiffler
6,846,354 B2 1/2005 Larsen
6,851,758 B2 2/2005 Beach
6,854,201 B1 2/2005 Hunter
6,854,810 B2 2/2005 Montgomery, Jr.
6,861,137 B2 3/2005 Griffin et al.
6,889,890 B2 5/2005 Yamazaki
6,962,395 B2 11/2005 Mouthaan
7,150,131 B2 12/2006 Barker
7,179,018 B2 2/2007 Hall
7,223,049 B2 5/2007 Hall
7,287,818 B1 10/2007 Hall
7,387,345 B2 6/2008 Hall
7,387,464 B2 6/2008 Hall
7,387,465 B2 6/2008 Hall
7,396,085 B2 7/2008 Hall
7,413,375 B2 8/2008 Hall
7,473,052 B2 1/2009 Hall
7,544,011 B2 6/2009 Hall
7,549,821 B2 6/2009 Hall
7,585,128 B2 9/2009 Hall
7,591,607 B2 9/2009 Hall
7,591,608 B2 9/2009 Hall
7,641,418 B2 1/2010 Hall
7,712,996 B2 5/2010 Hall
2002/0070602 A1 6/2002 Sollami
2002/0074851 A1 6/2002 Montgomery
2002/0153175 A1 10/2002 Ojanen
2002/0175555 A1 11/2002 Mercier
2003/0137185 A1 7/2003 Sollami
2003/0141350 A1 7/2003 Noro
2003/0141753 A1 7/2003 Peay
2003/0230926 A1 12/2003 Mondy
2003/0234280 A1 12/2003 Cadden
2004/0026983 A1 2/2004 McAlvain
2005/0159840 A1 7/2005 Lin
2005/0173966 A1 8/2005 Mouthaan
2006/0125306 A1 6/2006 Sollami
2008/0284235 A1 11/2008 Hall

* cited by examiner

909

909

HEATED LIQUID NOZZLES INCORPORATED INTO A MOLDBOARD

CROSS REFERENCE TO RELATED APPLICATIONS

This application is a continuation-in-part of U.S. patent application Ser. No. 12/888,876, filed on Sep. 23, 2010, now U.S. Pat. No. 7,976,238, which is a continuation-in-part of U.S. patent application Ser. No. 12/145,409, filed on Jun. 24, 2010, now U.S. Pat. No. 7,854,566, which was a continuation-in-part of U.S. patent application Ser. No. 11/566,151 filed on Dec. 1, 2006, now U.S. Pat. No. 7,458,645; Ser. No. 11/668,390, filed on Jan. 29, 2007, now U.S. Pat. No. 7,507,053 and Ser. No. 11/644,466, filed on Dec. 21, 2006, now U.S. Pat. No. 7,596,975. All of these documents are herein incorporated by reference for all that they disclose.

BACKGROUND OF THE INVENTION

The present invention relates to milling machines that are used in road surface repairs. Milling machines are typically utilized to remove a layer or layers of road surfaces in preparation for resurfacing. Milling machines are typically equipped with a milling drum and a moldboard. The moldboard may be located behind the milling drum and form part of a milling chamber that encloses the drum. Typically, milling machines are followed by a sweeper to clean up excess debris, aggregate, and fragments that remain on the milled surface. The drum and moldboard may be configured to direct milling debris toward a conveyer, which directs the debris to a dump truck to take off site.

Failure to clean the milled surface before resurfacing may result in poor bonding between the new layer and the milled surface. Typically, a sweeper is used to remove the debris and a distributor truck applies a tack coat to promote bonding between the milled surface and new layer of pavement. Generally, the sweepers that follow a milling machine are inefficient and the excess dust left may result in weak bonds between the new pavement and the milled surface.

BRIEF SUMMARY OF THE INVENTION

In one aspect of the present invention, a motorized vehicle comprises a vehicle frame. The vehicle frame comprises a forward end and a rearward end. A rotary degradation drum may be connected to an underside of the frame with a moldboard. The moldboard is disposed rearward to the rotary degradation drum and forms part of a milling chamber. The moldboard comprises an end disposed opposite the underside of the vehicle. A plurality of nozzles may be disposed proximate the end of the moldboard and configured to direct a fluid into the milling chamber. A heating mechanism may be configured to heat the fluid directed into the milling chamber.

A fluid reservoir may be disposed proximate at least one engine and/or an exhaust manifold disposed within the vehicle frame. The heating mechanism may comprise a heat exchanger configured to cool an engine of the machine. The heat exchanger may comprise at least in part, a pathway configured to circulate fluid within the engine. The pathway may connect the heat exchanger with a fluid reservoir and/or a fluid channel connected to the plurality of nozzles. The pathway may form a loop between the engine and the fluid reservoir or fluid channel. The heating mechanism may comprise a heat exchanger with the vehicle's exhaust system. The heating mechanism may also comprise a boiler, a resistive heater, an engine or combinations thereof configured to heat the fluid.

In another embodiment of the present invention, a method for paving a road may comprise providing a road milling machine with a rotary degradation drum and a moldboard forming part of a milling chamber, heating the fluid directed into the milling chamber, passing the milling machine over a pavement structure, heating the pavement structure with the fluid as the milling machine passes over the pavement structure, and paving a new layer of pavement over the pavement structure while the pavement structure is still warm.

The step of providing may further comprise the moldboard comprising a plurality of nozzles configured to direct a fluid into the milling chamber. The step of heating the fluid may comprise a heating mechanism in fluid communication with a reservoir and the plurality of nozzles. The heating mechanism may comprise a heat exchanger with the at least one engine or an exhaust manifold. The fluid may comprise steam, polymers, clays, oils, foams, wetting agents, surfactants, binding agents, or combinations thereof. The method may further comprise an additional step of degrading the pavement structure during the step of heating the pavement structure.

DETAILED DESCRIPTION OF THE INVENTION AND THE PREFERRED EMBODIMENT

Figure 1:
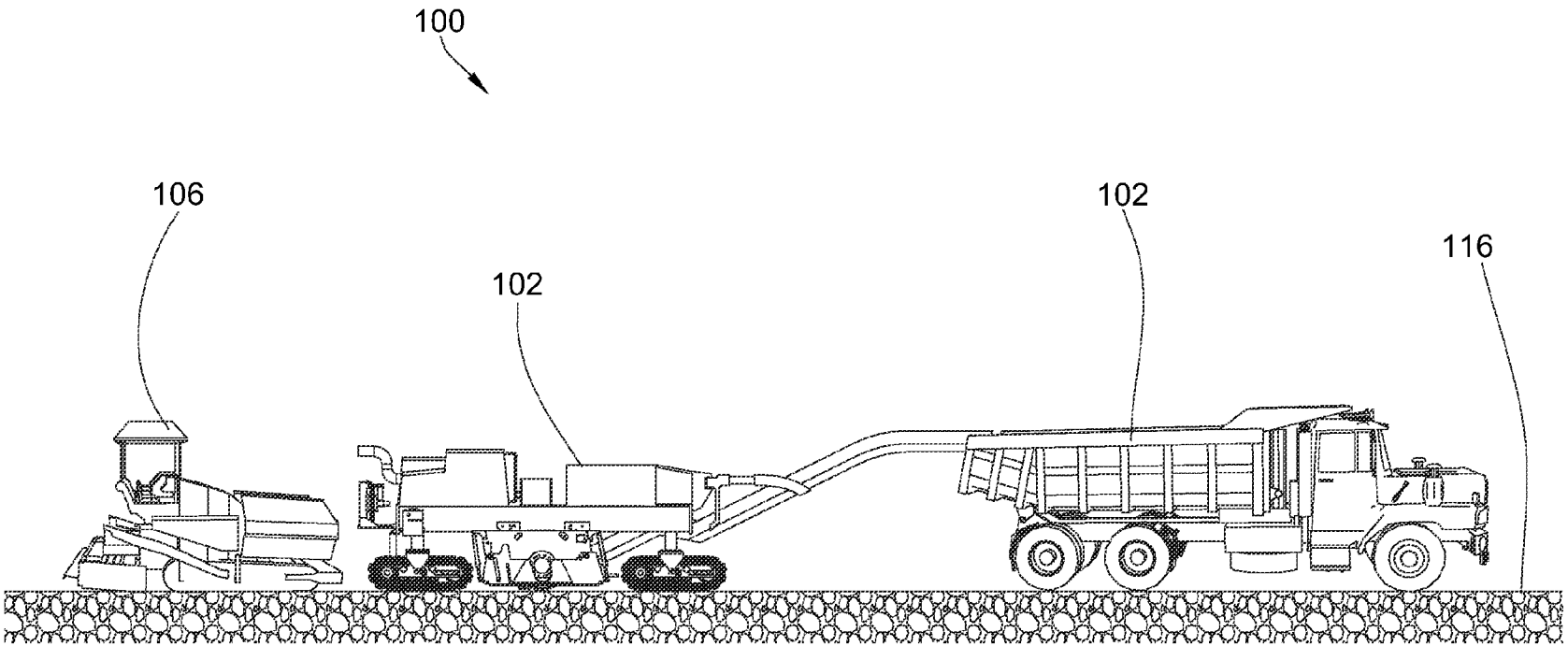
FIG. 1 is an orthogonal diagram of an embodiment of a road milling train.

FIG. 1 discloses an embodiment of a road milling train 100. The road milling train 100 may comprise a truck 102, a milling machine 104, and a paving machine 106. The current embodiment of the milling machine discloses the machine on tracks 102, but in other embodiments tires or other propulsion mechanisms may be used. The milling machine 104 may comprise a motorized vehicle with a milling chamber 108 attached to the underside. The milling chamber may comprise a milling drum 110, axle 112, and an opening for an end of a conveyor belt 114. The milling drum 110 may degrade the pavement structure 116 into aggregate. The conveyor belt 114 may be adapted to remove the aggregate from the milling chamber 108. The conveyor belt 114 may deposit the aggregate into a truck 102 ahead of the milling machine. The truck 102 may remove the aggregate from the milling area.

A paving machine may follow directly behind the milling machine. The present invention, which will be described in more detail below, puts the milled road surface into a condition ideal for paving. For example, the present invention is configured to clean the road surface, thereby eliminating a sweeper machine that is typically incorporated into milling trains. Also, the present invention is configured to heat the milled road surface, thereby providing a surface that is able to bond readily to a fresh layer of pavement. By paving immediately after the milling machine while the milled road surface is still hot, the need for a tact coat may be reduced or eliminated. In some embodiments, additives such as oils, clays, surfactants, wetting agents, binding agents, polymers, and combinations thereof may be deposited on the milled road surface by the milling machine. Thus, the present invention is capable of significantly reducing the milling/paving train and significantly reduce the time and cost associated with resurfacing roads.

Figure 2:
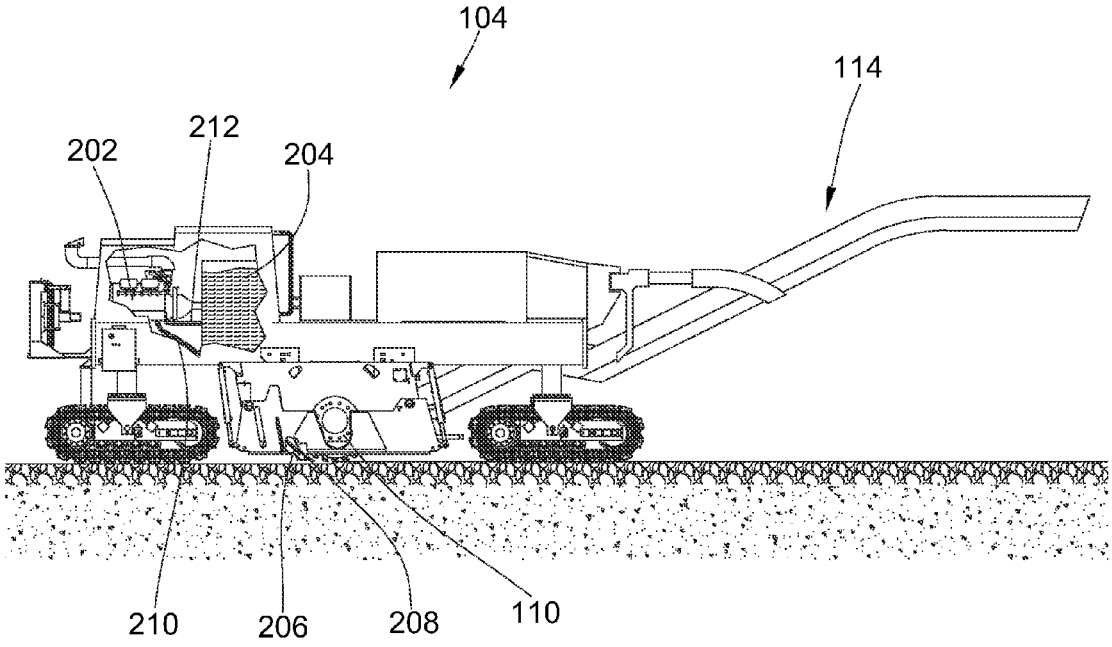
FIG. 2 is an orthogonal diagram of an embodiment of a milling machine.

FIG. 2 discloses an embodiment of a milling machine 104. The milling machine 104 may comprise an engine 202, a fluid reservoir 204, and a moldboard 206. The moldboard 206 may comprise a plurality of nozzles 208 in fluid communication with the engine 202 through a first fluid channel 210. The engine 202 and the fluid reservoir 204 may be in fluid communication through a second fluid channel 212. The fluid in the reservoir 204 may be directed through the second fluid channel 212 into the engine 202. The fluid may exchange heat with the engine 202 before the fluid enters into the first fluid channel 210 on its way to the nozzles.

The fluid reservoir may contain any fluid capable of cleaning the road surface. In some embodiments, water is the preferred. Additives, such as additives such as oils, clays, surfactants, wetting agents, binding agents, polymers, and combinations may be mixed with the liquid in the fluid reservoir. In other embodiments, additives may be stored on the milling machine separately. In such embodiments, the additives may be added to the fluid before the fluid exits the nozzles or the additives may be added to the road surface separately. The additives may be added through by spraying, misting, foaming, fogging, or combinations thereof. In some embodiments, the additives may be heated with the fluid, heated separately, or heated from contact with the heated milling surface. While some embodiments include additives to the fluid, other embodiments do not include the use of additives.

Figure 3:
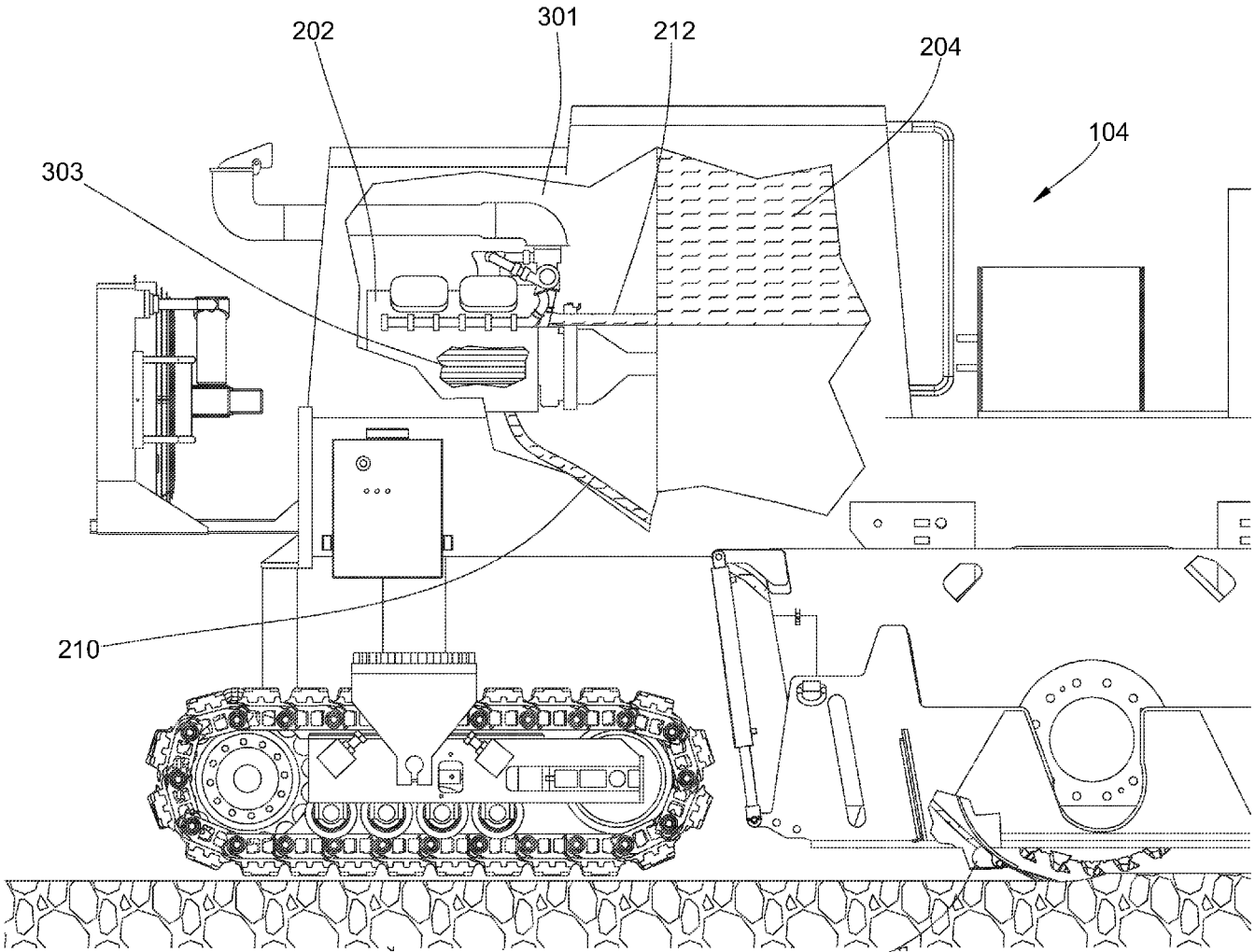
FIG. 3 is an orthogonal diagram of an embodiment of a milling machine.

FIG. 3 discloses an embodiment of a heating mechanism 301. The heating mechanism 301 may be disposed within a milling machine 104 and comprise at least one engine 202 in fluid communication with a fluid reservoir 204. The at least one engine 202 may comprise a fluid conduit 303 disposed within at least a portion of the engine 202. The fluid conduit 303 may comprise fluorinated ethylene propylene, perfluoroalkoxy, or any thermally conductive material with a high working temperature.

The fluid may be directed from the fluid reservoir 204 through the second fluid channel 212 into the fluid conduit 303 disposed in the at least one engine 202. As the fluid passes through the conduit 303, heat from the engine 202 may be transferred into the fluid replacing the need for a cooling system and radiator while heating the fluid. The fluid may exit the engine 202 and be directed to a plurality of nozzles 208 through the first fluid channel 210. The first fluid channel 210 may be thermally insulated to prevent thermal energy loss before reaching the nozzles 208. The thermal insulation may comprise insulating foam, thermally insulating pipes, or a combination thereof. In some embodiments of the present invention, the fluid directed to the plurality of nozzles 208 may be compressed to further increase the fluid temperature.

While not shown, a compressor or other compression mechanism may be configured to pressurize the fluid before it exits the nozzles. Pressurizing the fluid may allow the fluid to be at a hotter temperature while still in a liquid state. As the heated, pressurized liquid exists the nozzles, the liquid may flash to a gas. In some cases, pressure may be applied, but not enough pressure to turn the liquid into a gas.

Figure 4:
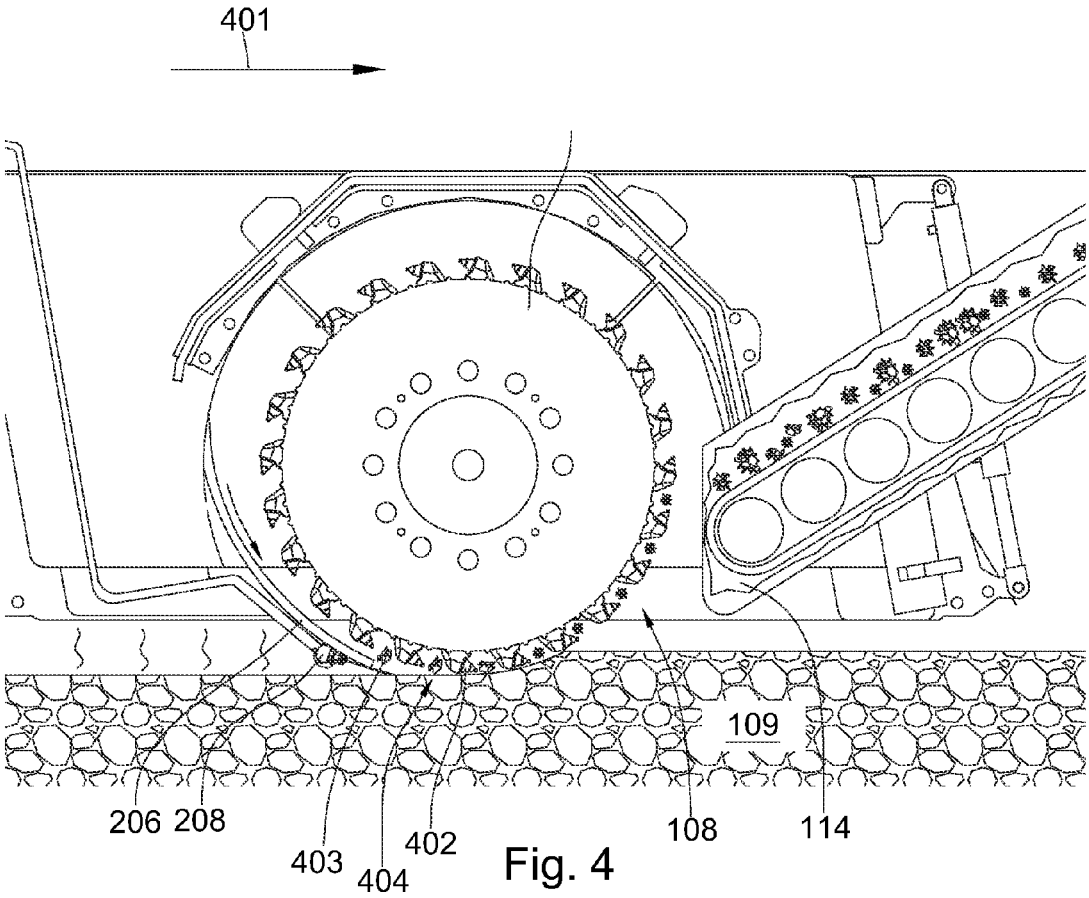
FIG. 4 is a cross-sectional view of an embodiment of a milling chamber.

FIG. 4 discloses an embodiment of the milling chamber 108 and the conveyor belt 114. In this embodiment the milling machine 104 is traveling to the right as disclosed by arrow 401, and the drum 110 rotates counter-clockwise. The picks 402 degrade the paved surface by rotating into the paved surface as the milling machine 104 travels forward. The picks 402 may comprise tungsten carbide or synthetic diamond tips. The picks 402 may lift broken aggregate 403 from the milling area 404 in which a portion of the aggregate 403 will fall onto the conveyor belt 114. The remaining aggregate 403 may continue around the milling drum 110 and fall off onto the moldboard 405 or into the cut formed by the drum.

The moldboard 405 is disposed rearward of the milling drum 110 and may push loose aggregate 403 forward into the milling area 404. A plurality of nozzles 406 may be disposed on the rear side of the moldboard and aligned to force the aggregate forward. The plurality of nozzles 406 may be in fluid communication with the fluid reservoir. As the milling machine 104 moves forward the plurality of nozzles may eject a fluid into the milling chamber forcing aggregate into the milling area 404 where the milling drum may pick it up.

The fluid ejected from the nozzles may be heated. As the heated fluid exits, the fluid may take the form of either liquid or gas. The heated fluid may push the aggregate forward and then rapidly evaporate leaving the milled surface dry. A heated, dry milled surface may be ideal for bonding with a fresh layer of pavement.

Figure 5:
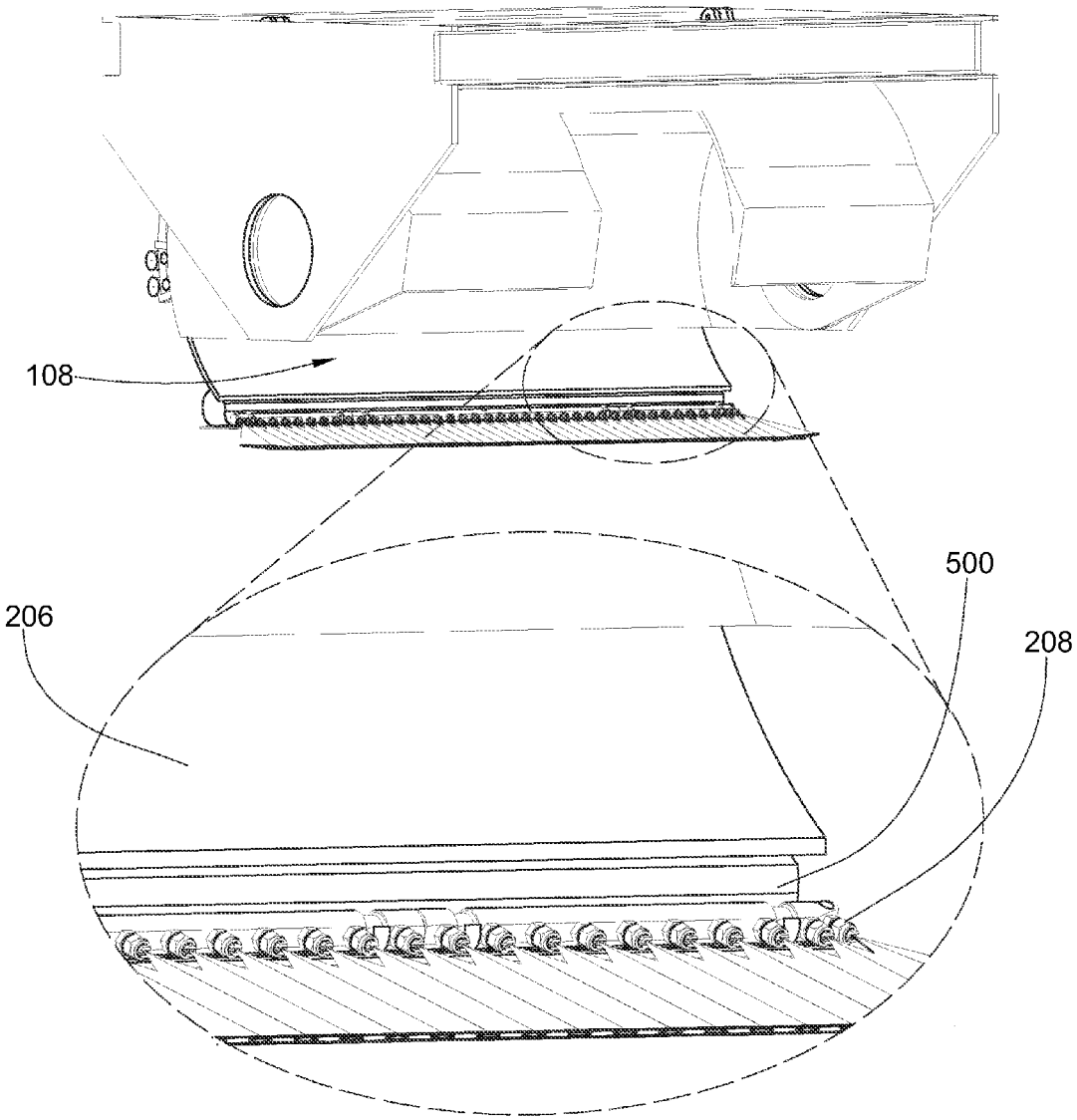
FIG. 5 is a perspective diagram of an embodiment of a moldboard.

FIG. 5 discloses a milling chamber 108 with a moldboard 206 and the plurality of nozzles 208. In this embodiment, the milling drum 110 has been removed for illustrative purposes. The fluid may travel down the fluid pathway and into a fluid manifold 500. The fluid manifold 500 may attach to the plurality of nozzles 208 and distribute the fluid to each nozzle 208. The plurality of nozzles 208 may extend across the moldboard's width.

Figure 6:
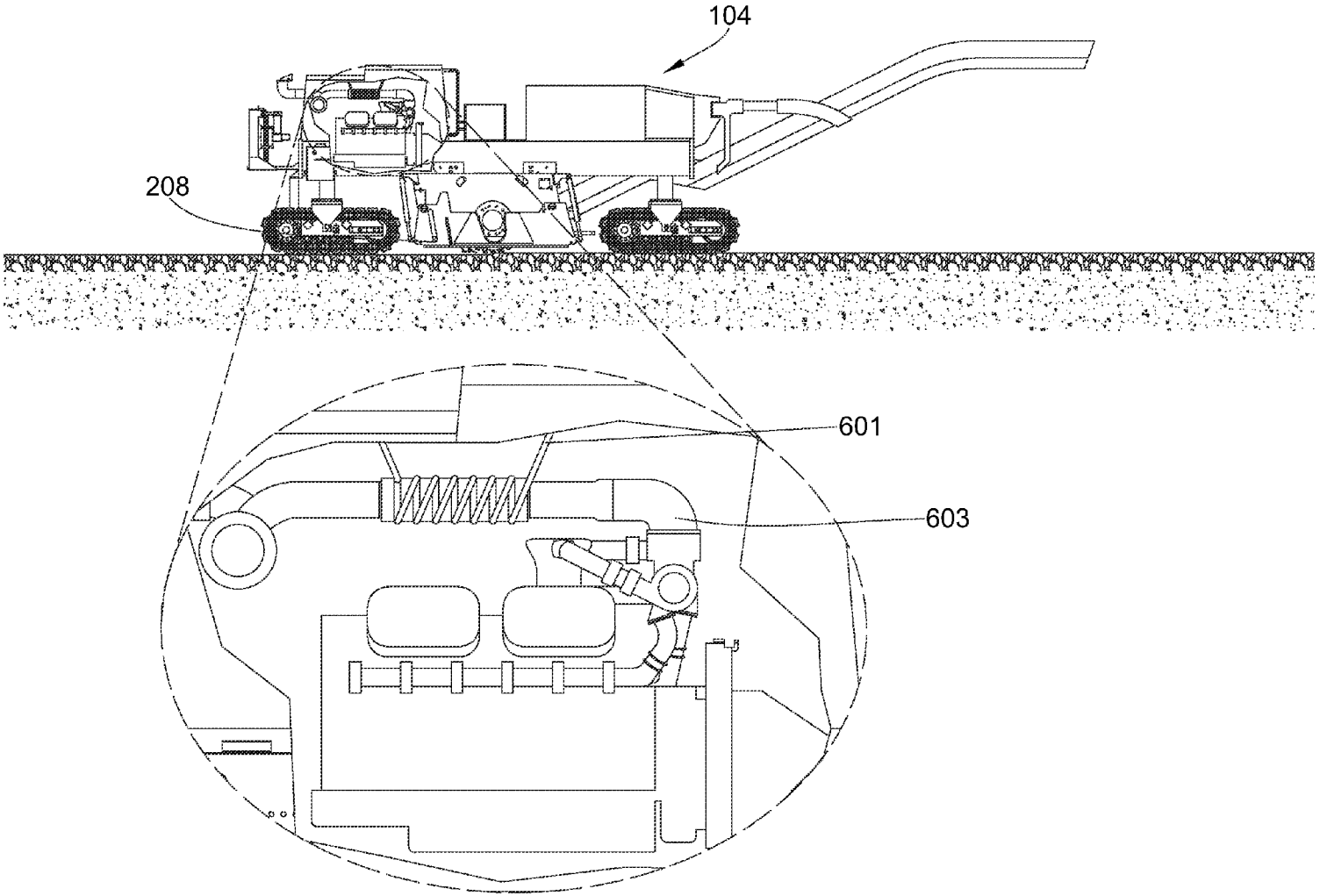
FIG. 6 is an orthogonal diagram of an embodiment of a milling machine.

FIG. 6 discloses another embodiment of a milling machine 104. The milling machine 104 may exchange heat between a fluid pathway 601 and an exhaust manifold 603. The fluid pathway 601 may be in fluid communication with a reservoir and a plurality of nozzles 208. In another embodiment of the present invention, a compressor or a boiler may also be in fluid communication with the heat exchanger to further increase the temperature of the fluid. The heated fluid may be directed to a plurality of nozzles 208. The nozzles 208 may be disposed to remove aggregate from the milled surface while heating the newly exposed pavement.

Figure 7:
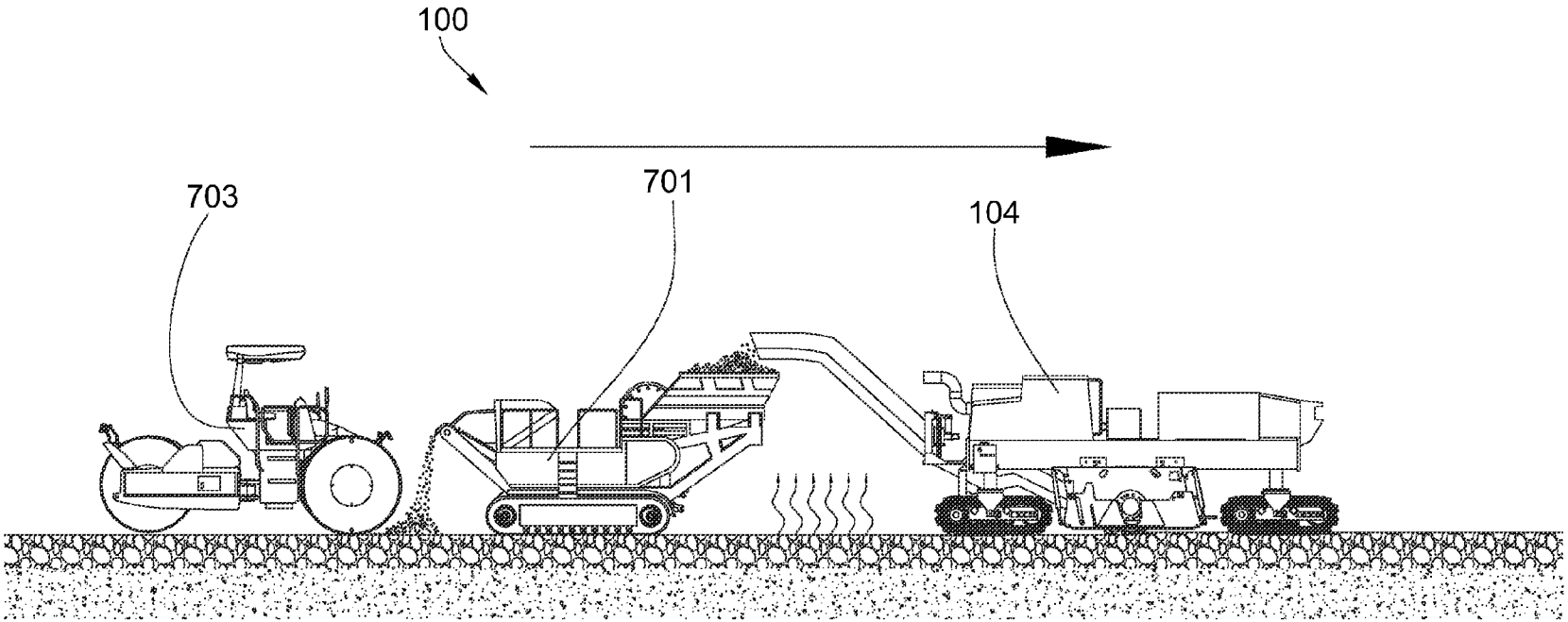
FIG. 7 is an orthogonal diagram of an embodiment of a road milling train.

FIG. 7 discloses another embodiment of a road milling train 100. The road milling train 100 may comprise a road milling machine 104, a pavement recycling machine 701, and a road roller 703. The road milling machine 104 may remove the top surface of the road and dump it into the pavement recycling machine 701. The pavement recycling machine 701 may further heat the aggregate and mix in additional aggregiate and oils. The new mix of heated pavement may be deposited on the milled surface and a road roller may smooth out the pavement. This embodiment also enabled by the present invention because the clean, heated milled surface is in an ideal condition for bonding to a new layer of pavement.

Figure 8:
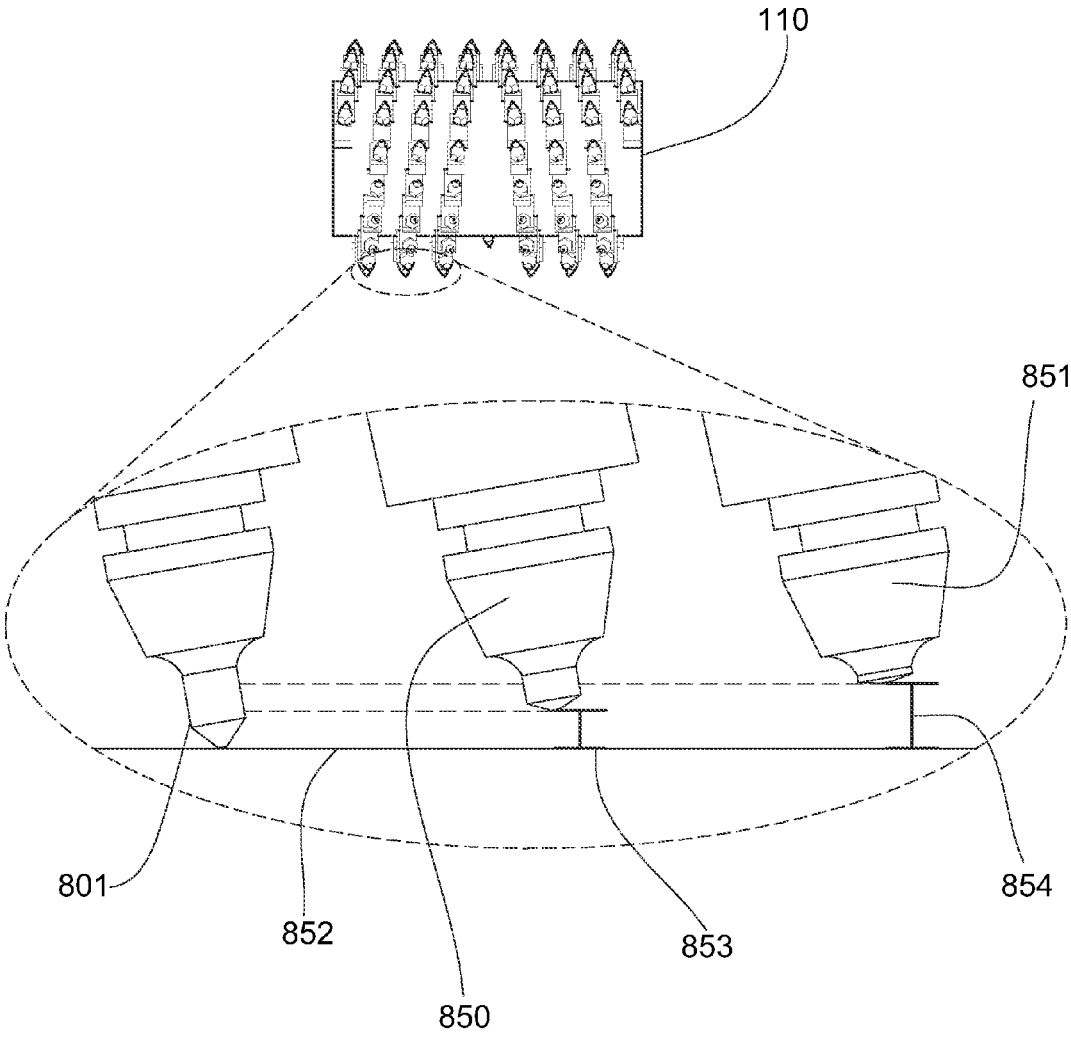
FIG. 8 is an exploded view of an embodiment of a milling drum.

FIG. 8 discloses a milling drum 110 comprising a plurality of tungsten carbide bits 801. While the drum is in operation, the bits 801 wear. Each bit 801 may wear at different rates; however, the bits toward the middle of the milling drum 110 may wear at a faster rate than those toward the ends of the milling drum 110. As the bits 801 wear down, the more worn bits 801 may remove less pavement resulting in an irregular milled surface. Since the bits may wear at different rates, the bits are replaced at different times as well. This leads to greater irregularity among the pick's height.

Figure 9A:
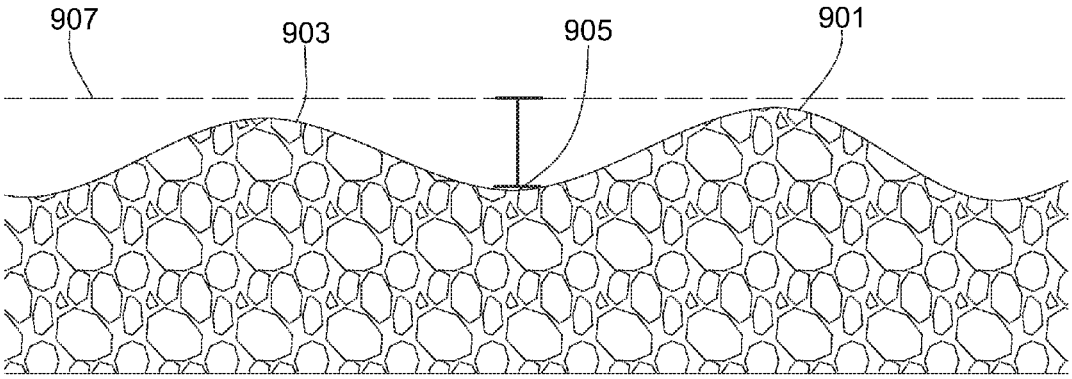
FIG. 9*a* is a cross-sectional view of an embodiment of a milled surface.

FIG. 9*a* discloses a first milled surface 901 using a milling drum with tungsten carbide bits. The first milled surface 901 may comprise a plurality of peaks 903 and valleys 905 formed from the inconsistent pick heights' of the drum. In order for the milling machine to reach a required removal depth 907, the drum must be positioned at a level that allows the shortest (or most worn) bit to cut at the required removal depth. Unfortunately, the other picks have greater heights; therefore, they will cutter deeper into the road surface than required. The result is an uneven road surface with the majority of the milled surface cut deeper than required. Thus, resurfacing job is more costly than necessary because more pavement must be replaced and additional energy used to cut deeper than necessary was wasted.

Figure 9B:
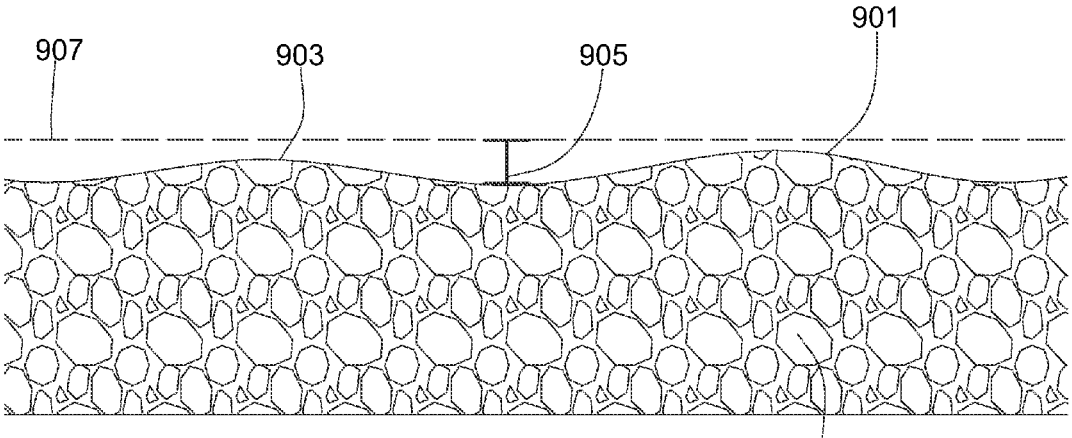
FIG. 9*b* is a cross-sectional view of an embodiment of a milled surface.

FIG. 9*b* discloses a second milled surface 911 using a milling drum with polycrystalline diamond bits and heated fluid. The second milled surface 911 may comprise a plurality of peaks 903 and valleys 905. However, the distance between the peaks 903 and valleys 905 is significantly less. Polycrystalline diamond bits may wear at a significantly reduced rate than tungsten carbide bits, thus, reducing the distance between the peaks 903 and valleys 905. As the distance is reduced, less pavement is removed to reach the required removal depth 907. Thus, the diamond enhanced teeth provide greater energy efficiency and reduce replace material costs.

Figure 10A:
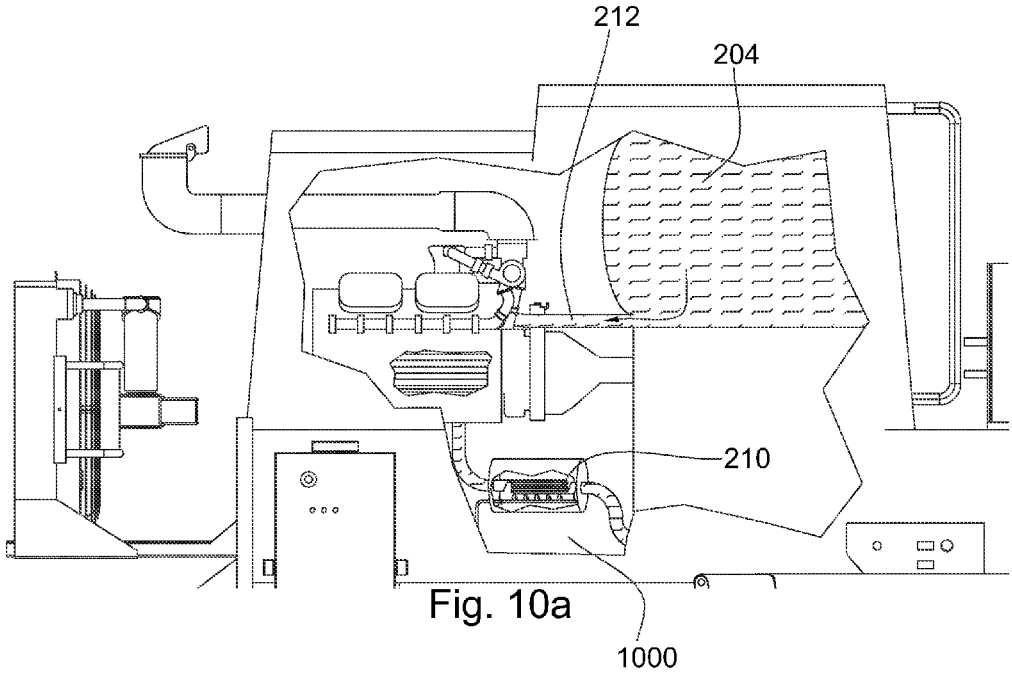
FIG. 10*a* is an orthogonal diagram of an embodiment of a milling machine.

FIG. 10*a* discloses an additional heating element 1000 positioned along the fluid path 210. Thus, if the engine fails to exchange the desired heat with the fluid, the additional heating element may bring the fluid to the desired temperature. The additional heating element may be a boiler, an open flame, a resistive heater, or combinations thereof. Additionally, a pressurizing mechanism may be configured to increase the pressure exerted on the fluid to help influence the fluid's temperature.

Figure 10B:
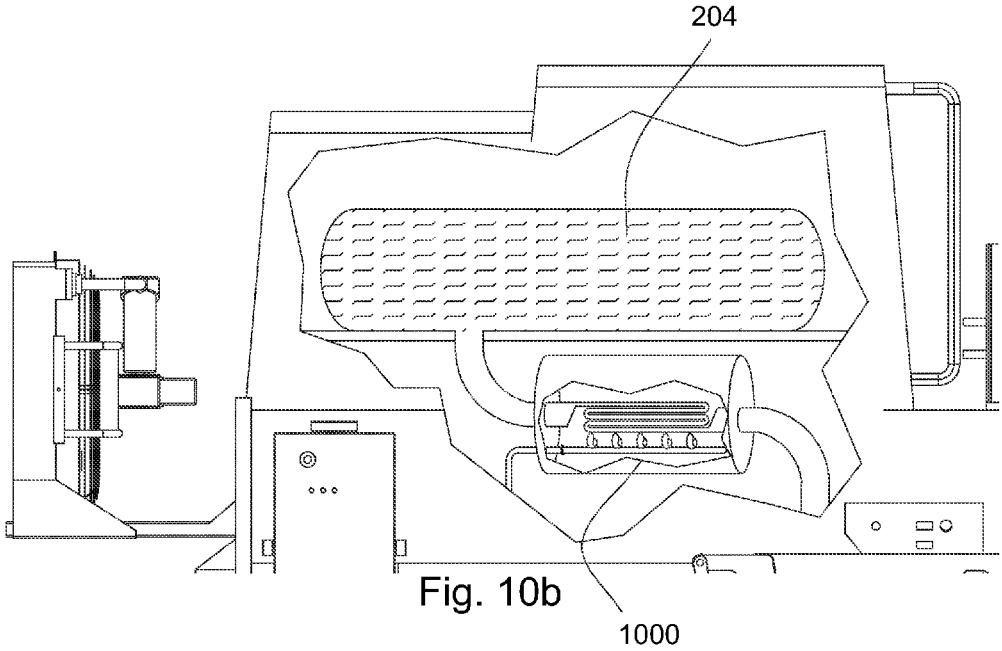
FIG. 10*b* is a cross-sectional view of an embodiment of a milling chamber.

FIG. 10*b* discloses that the fluid is not heated by the engine, but it heated by a heating element, which may be selected from the group consisting of resistive heaters, boilers, open flames, or combinations thereof

What is claimed is:

1. A motorized vehicle, comprising:

a vehicle frame comprising a forward end and rearward end;

a rotary degradation drum connected to an underside of the frame;

a moldboard disposed rearward to the rotary degradation drum and forming part of a milling chamber;

the moldboard comprising an end disposed opposite the underside;

a conveyor belt to remove aggregate from the milling chamber;

a plurality of nozzles disposed proximate the end of the moldboard and configured to direct a fluid into the milling chamber; and a heating mechanism is configured to heat the fluid.

2. The vehicle of claim 1, wherein the fluid exchanges heat with an engine of the machine.

3. The vehicle of claim 2, further comprising a heat exchanger comprising a pathway that is configured to pass fluid through the engine.

4. The vehicle of claim 1, further comprising a compression mechanism configured to increase the temperature of the fluid.

5. The vehicle of claim 4, wherein the compression mechanism is configured to pressurize the fluid to allow increased liquid temperatures thereby allowing the liquid flashing to a gas as it exists the nozzles.

6. The vehicle of claim 1, wherein the heating mechanism comprises a boiler configured to heat the fluid.

7. The vehicle of claim 1, wherein a pathway is heated by an engine of the machine and an additional heating element.

8. The vehicle of claim 1, wherein the fluid comprises additives.

9. The vehicle of claim 8, wherein the additives comprise oil, clay, surfactants, or combinations thereof.

10. The vehicle of claim 1, wherein the fluid comprises water.

11. The vehicle of claim 1, wherein the heating element is configured to heat the fluid above the fluid's boiling point.

12. A method for paving a road, comprising the steps of:

providing a road milling machine with a rotary degradation drum and a moldboard forming part of a milling chamber, the moldboard comprising a plurality of nozzles configured to direct a fluid into the milling chamber;

heating the fluid directed into the milling chamber;

passing the milling machine over a pavement structure;

removing aggregate from the milling chamber by a conveyor belt;

heating the pavement structure with the fluid as the milling machine passes over the pavement structure; and paving a new layer of pavement over the pavement structure while the pavement structure is still warm.

13. The method of claim 12, wherein the fluid may comprise steam, polymers, surfactants, binding agents, or combinations thereof.

14. The method of claim 12, wherein the step of heating the fluid comprises a heating mechanism in fluid communication with a reservoir and the plurality of nozzles.

15. The method of claim 14, wherein the reservoir is disposed on the milling machine.

16. The method of claim 12, wherein the heating mechanism comprises a heat exchanger.

17. The method of claim 16, wherein the heat exchanger may exchange heat with at least one engine.

18. The method of claim 16, wherein the heat exchanger may exchange heat with an exhaust manifold.

19. The method of claim 12, wherein the method comprises an additional step of degrading the pavement structure during the step of heating the pavement structure with the fluid.

* * * * *